US011072199B2

(12) United States Patent
Roy

(10) Patent No.: US 11,072,199 B2
(45) Date of Patent: Jul. 27, 2021

(54) DEVICE FOR TENSIONING A CANVAS ON A FRAME

(71) Applicant: GESPLAN GESTION CONSEIL, INC., Lévis (CA)

(72) Inventor: Francois Roy, Lévis (CA)

(73) Assignee: GESPLAN GESTION CONSEIL INC.

( * ) Notice: Subject to any disclaimer, the term of this patent is extended or adjusted under 35 U.S.C. 154(b) by 0 days.

(21) Appl. No.: 16/977,064

(22) PCT Filed: Jan. 30, 2019

(86) PCT No.: PCT/CA2019/050110
§ 371 (c)(1),
(2) Date: Aug. 31, 2020

(87) PCT Pub. No.: WO2019/169474
PCT Pub. Date: Sep. 12, 2019

(65) Prior Publication Data

US 2020/0406666 A1 Dec. 31, 2020

Related U.S. Application Data

(60) Provisional application No. 62/638,084, filed on Mar. 3, 2018, provisional application No. 62/681,010, filed on Jun. 5, 2018, provisional application No. 62/750,793, filed on Oct. 25, 2018.

(51) Int. Cl.
*B44D 3/18* (2006.01)

(52) U.S. Cl.
CPC ..... *B44D 3/185* (2013.01)

(58) Field of Classification Search
CPC ..... B44D 3/185
See application file for complete search history.

(56) References Cited

U.S. PATENT DOCUMENTS 1,916,022 A * 6/1933 Shull ..... B44D 3/185 160/374.1
2,149,985 A * 3/1939 Tepper ..... B44D 3/185 160/374.1
2,538,138 A * 1/1951 Webster ..... E06B 3/9646 52/657
2,838,081 A * 6/1958 Larson ..... B25B 5/142 269/87.1

(Continued)

*Primary Examiner* — Brian Handville
(74) *Attorney, Agent, or Firm* — QuickPatents, LLC; Kevin Prince

(57) ABSTRACT

A device for stretching a canvas mounted to a frame comprises a spacer and a screw. The frame has a plurality of side members each mutually abutting at angled ends. A first portion of the spacer includes a central aperture therethrough and two opposing ends or sides. Each end of the first portion is sized to engage a contact surface of each side member. The screw has a threaded shaft adapted for rotational engagement with the central aperture of the first portion of the spacer. The threaded shaft terminates at a first end thereof with a screw head that has a frustoconical side wall and an end surface that includes a tool-engaging recess. Rotating the screw to move the screw head closer to the spacer causes the spacer to push the side members mutually away from each other to stretch the canvas.

20 Claims, 6 Drawing Sheets

(56) References Cited

U.S. PATENT DOCUMENTS

| | | | | |
|---|---|---|---|---|
| 3,230,872 | A * | 1/1966 | De Groot | B41F 15/36<br>101/127.1 |
| 4,076,438 | A * | 2/1978 | Bos | E06B 3/982<br>403/297 |
| 8,936,065 | B1 * | 1/2015 | Gillespie | B44D 3/185<br>160/371 |

* cited by examiner

DEVICE FOR TENSIONING A CANVAS ON A FRAME

CROSS-REFERENCE TO RELATED APPLICATIONS

This application is a national-stage application number 35 USC 371 of PCT Application # PCT/CA2019/050110, filed on Jan. 30, 2019, which claims the benefit of U.S. Provisional Patent Applications 62/638,084, filed on Mar. 3, 2018; 62/681,010, filed on Jun. 5, 2018; and 62/750,793, filed on Oct. 25, 2018, all incorporated herein by reference.

STATEMENT REGARDING FEDERALLY SPONSORED RESEARCH AND DEVELOPMENT

Not Applicable.

FIELD OF THE INVENTION

The present invention relates to the field of wooden frames for painter's canvas and printed canvas, and relates specifically to a device for tensioning a canvas on a frame comprising a plurality of side members mutually affixed at their angled ends.

DISCUSSION OF RELATED ART

The solution for tensioning a canvas on a frame that is the easiest in term of tools consist in applying on a frame a piece of canvas of a larger size than the frame, then folding down the canvas along the four bars which forms the frame, while pulling on the canvas, for instance using a stretching plier, securing the canvas along the bars, for instance by stapling, while leaving free the canvas at the corner, and then, at each corner of the frame, folding back on itself the free part of the canvas so as to form folds which overlap, and then stapling the folds to the frame.

The above solution has the drawbacks that it requires the use of a stretching plier and that it is relatively time-consuming to implement if one wishes to correctly tension the canvas, since the user should tension it correctly all along the bars before securing it thereto. This must particularly be the case when the frames are of a larger size.

Furthermore, this solution supposes either that the user already has an assembled frame, or that the user assembles himself the four bars of the frame, which is an additional work which once again requires tools and is not easy for frames of larger sizes.

Some of my previous patents utilize rigid spacers that cooperate with a tensioner element that is fixed with the side members of the frame. The spacer and the side members are pushed away from each other with a screw to effect canvas stretching. However, such prior solutions require excessive parts and as such are costly to manufacture.

Therefore, there is a need for a device that has a minimum of parts, yet that can still effect stretching of the canvas by separation of the side members. Such a needed invention would be relatively inexpensive to manufacture and yet intuitive to use. The present invention accomplishes these objectives.

SUMMARY OF THE INVENTION

The present device is a device for stretching a canvas mounted to a frame comprising a plurality of side members each mutually abutting at angled ends. Each angled end has at least an inside surface, an angled end surface that has a groove open to each angled end surface, and an outside surface. The angled end includes a contact surface oriented at a first angle, such as 90-degrees, with respect to the longitudinal axis of the side member.

In a preferred embodiment of the invention, the device comprises a spacer and a screw. A first portion of the spacer includes a central aperture therethrough and two opposing ends. Each end of the first portion is sized to engage contact surface of one of the side members when the aperture is positioned between two of the abutting side members.

The screw has a threaded shaft adapted for rotational engagement with the central aperture of the first portion of the spacer. The threaded shaft is at least partially contained within the groove of each side member when the side members are abutting, and terminates at a first end thereof with a screw head that has, in some embodiments, a frustoconical side wall and an end surface that includes a tool-engaging recess, such as a Phillips slot for engaging a Phillips screwdriver, or the like. The side wall of the screw head is preferably angled with respect to the longitudinal axis of the threaded shaft at a fourth angle, preferably 45-degrees, such that a line of contact is formed between the screw head and the inside surface of the side members.

In use, with the spacer fixed between the abutting side members with each end of the first portion contacting the contact surface of the angled end, and with the screw threaded through the central aperture of the first portion and the side wall of the screw head contacting the inside surface of each side member, rotating the screw to move the screw head closer to the spacer causes the spacer to push the side members mutually away from each other along their respective longitudinal axes to stretch the canvas.

In a preferred embodiment of the invention, the spacer includes adjacent sides that are sized to engage the contact surface of the side member, which is orthogonal to the longitudinal axis of the side member. The screw head of the screw in such an embodiment either has its own angled side wall, or takes the form of a conventional screw having a screw collar having an angled side wall and an axial aperture therethrough to receive the screw. Such a screw collar may be formed of, for example, a plastic or metal material, and is preferably separable from the screw. As such a wide variety of different screws may be utilized as long as they engage the central aperture of the spacer and the axial aperture of the screw collar. Preferably the side members used in the preferred embodiment of the device each include a mortise and a tenon, such that the side members can be made identical and they will interlock when flipped with respect to each other and brought into abutting contact.

Further, in some embodiments, at least one elongated cross bar is included for applying tension between two opposing side members of a frame comprising four (or more) of the side members. Each cross bar includes two opposing ends that each have a channel therein for receiving an expansion screw and a threaded spacer that is fixed with each of the opposing ends of the at least one elongated cross bar. The threaded spacer includes a central aperture adapted for receiving the expansion screw therethrough. As such, with the cross bar fixed between two opposing side members the expansion screws can be rotated to cause the expansion screws to move from a retracted position to extended positions in order to apply tension between the two opposing side members.

The present invention is a device that has a minimum of parts, namely two, and yet can affect sufficient stretching of the canvas by separation of the side members. The present invention is relatively inexpensive to manufacture and yet is also intuitive to use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
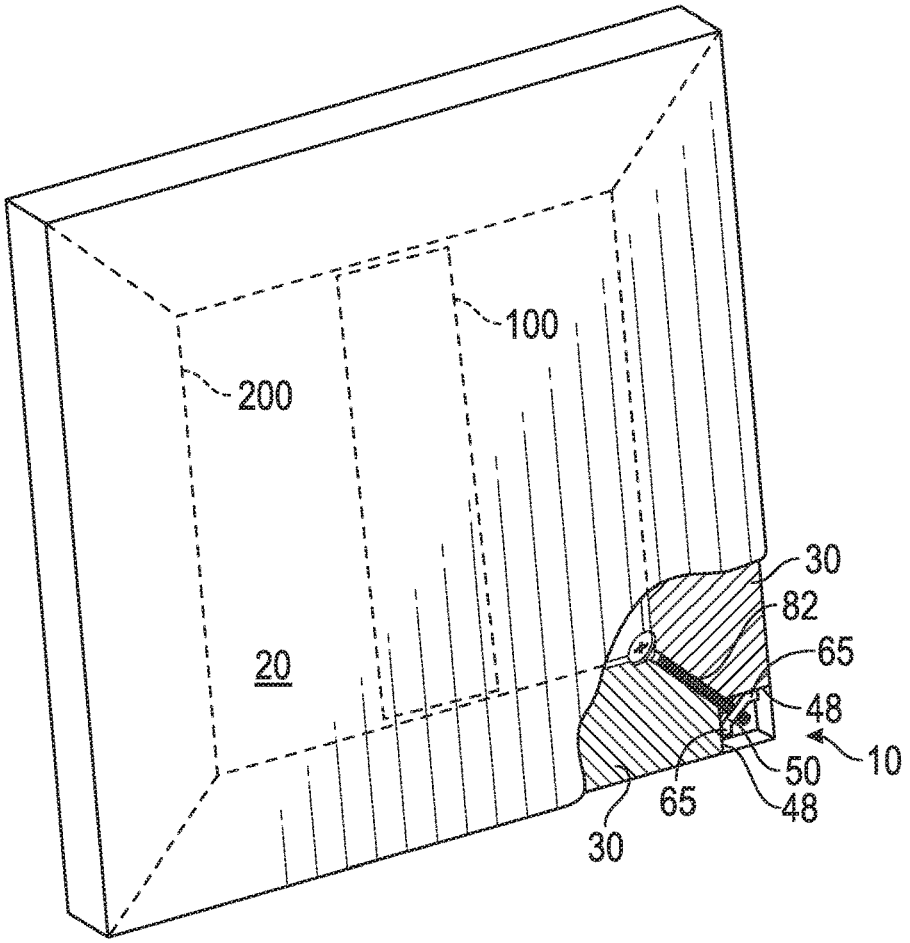
FIG. 1 is a perspective view of a canvas mounted to a frame comprising a plurality of side members, the canvas partially cut-away.
Figure 2:
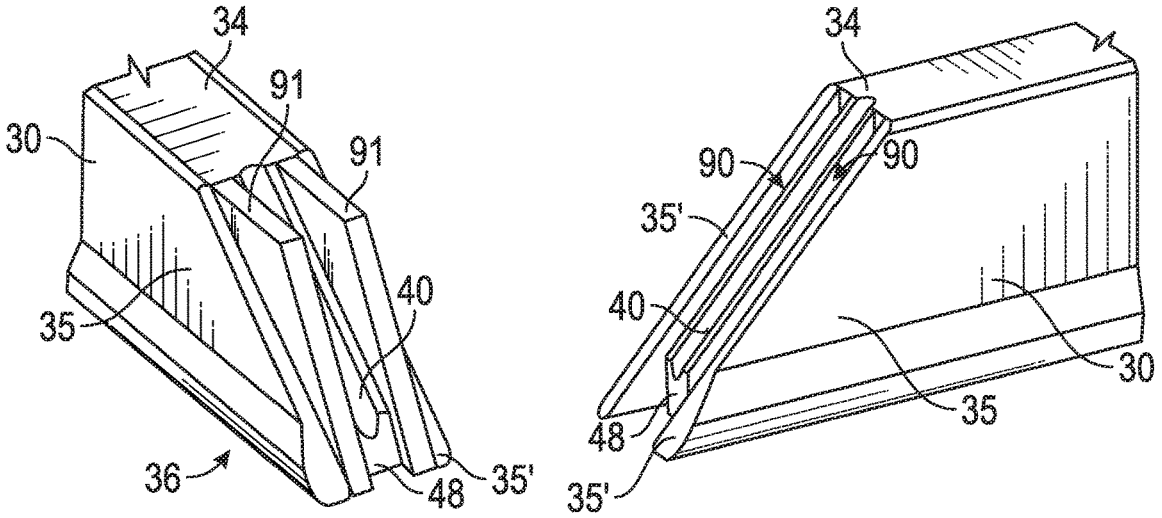
FIG. 2 is a partial perspective view of angled ends of two of the side members designed to abut each other.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate a device 10 for stretching a canvas 20 mounted to a frame comprising a plurality of side members 30 each mutually abutting at angled ends 35. Each angled end 35 has at least an inside surface 34, an angled end surface 35' (FIG. 2) that has a groove 40 open to each angled end surface 35', and an outside surface 36. The groove 40 has a contact surface 48 oriented at a first angle $\alpha_1$, such as 90-degrees, with respect to the longitudinal axis $L_1$ (FIG. 3) of the side member 30. Preferably each angled end 35 includes either a mortise 90 or a cooperative projecting tenon 91, or both, for interlocking two of the side members 30 together.

It is understood that most frames will comprise four of the side members 30 and four of the devices 10, all used together to stretch the canvas 20 to form a suitable rectangular painting surface. With such typically frames, each angled end 35 is formed at a 45-degree angle. However, other shapes of frames may be contemplated, such as hexagonal, in which case the frame will have six of the side members 30 and six of the devices 10. Adjacent side members 30 in such a hexagonal frame will have a 120-degree angles between them, and the angled ends 35 of such side members will be angled at a 60-degree angle.

It is understood that the device 10 may be sold individually, in sets of 2, 4, 6, etc., or may also be sold with the side members 30 sufficient in number to assemble the entire frame. For ease of illustration, the balance of this disclosure and the drawings focus on just a single device 10 and two of the side members 30 that are connected to each other via the device 10.

Figure 3:
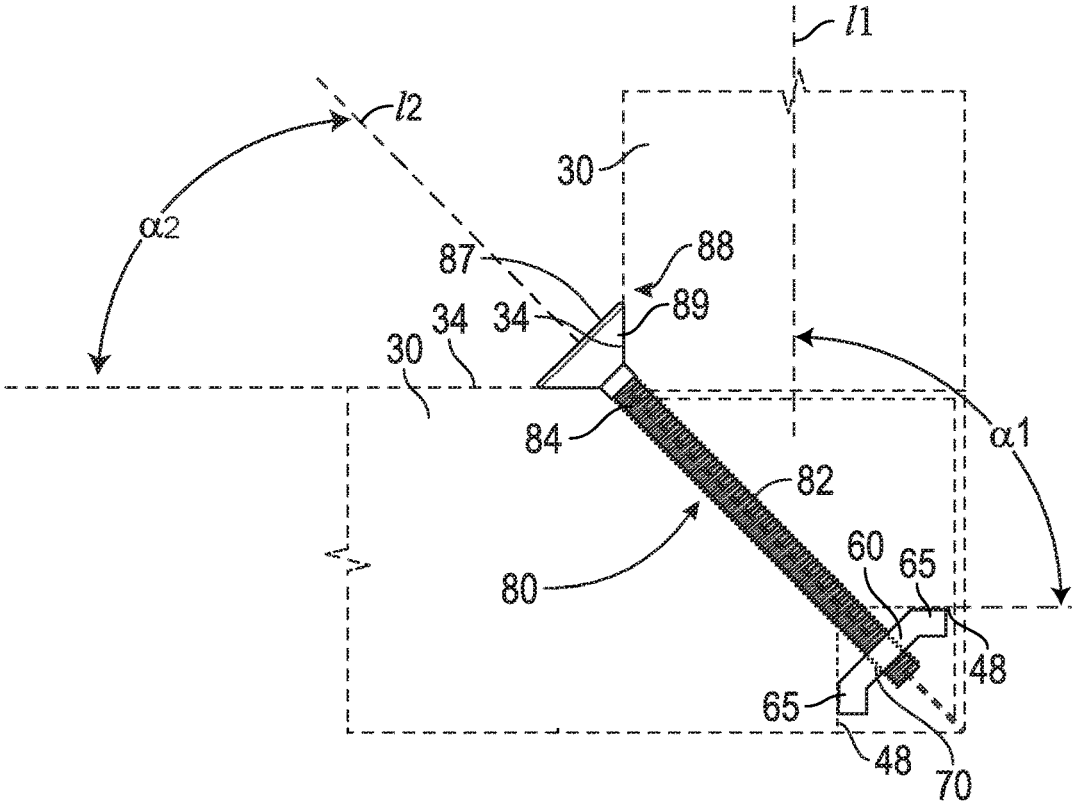
FIG. 3 is a perspective view of the invention, illustrating the side members in cross-section for ease of illustration, the invention in a retracted position with the angled ends of each side member in close contact.
Figure 4:
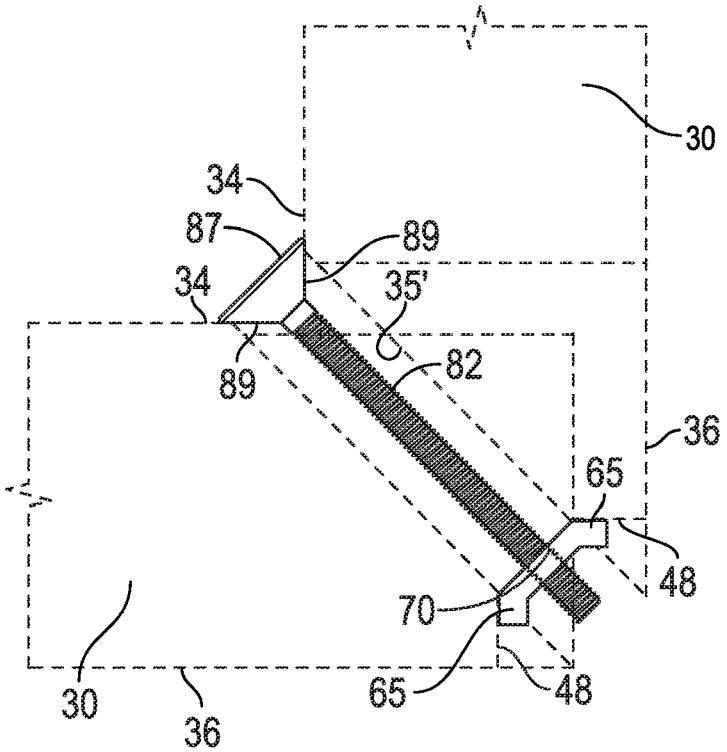
FIG. 4 is a perspective view of the embodiment of FIG. 3 but with the invention in a somewhat extended position with the angled ends of each side member spaced mutually apart by the invention.

In one embodiment of the invention, the device 10 comprises a spacer 50 and a screw 80. A first portion 60 of the spacer 50 includes a central aperture 70 therethrough and two opposing ends 65. Each end 65 of the first portion 60 is sized to engage the contact surface 48 of one of the side members 30 when the aperture 70 is positioned between two of the abutting side members 30 (FIGS. 3 and 4). The spacer 50 is preferably made from a strong and rigid metal or plastic material.

Figure 8A:
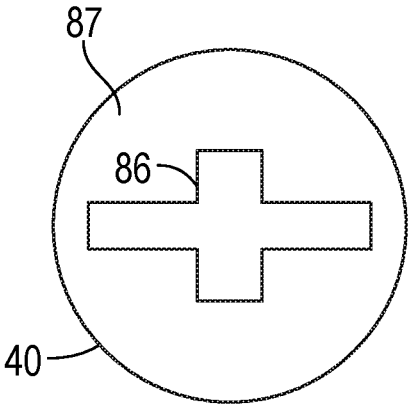
FIG. 8A is a top plan view of a screw head of the invention adapted to engage two different types of screw drivers, namely a Phillips screwdriver and a flat head screwdriver.
Figure 8B:
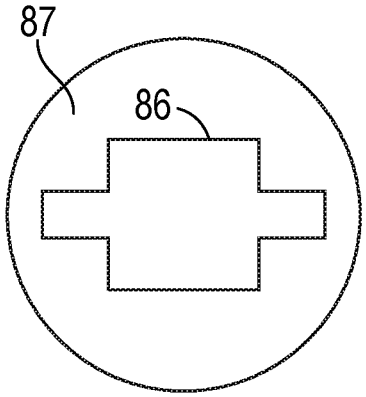
FIG. 8B is a top plan view of a screw head of the invention adapted to engage two different types of screw drivers, namely a Robertson screwdriver and a flat head screwdriver.

The screw 80 has a threaded shaft 82 adapted for rotational engagement with the central aperture 70 of the first portion 60 of the spacer 50. The threaded shaft 82 terminates at a first end 84 thereof with a screw head 88 that has preferably a frustoconical side wall 89 (FIG. 3) or a rounded edge (FIG. 5B), and an end surface 87 that includes a tool-engaging recess 86, such as a Phillips slot for engaging a Phillips screwdriver (FIG. 8A), a single slot for engaging a flat or regular screwdriver (FIGS. 8A, 8B), a hexagonal recess for engaging an Allen wrench (not shown), a combination of a Phillips and flathead slot 86 (FIG. 8A), a combination of a Robertson and flathead slot 86 (FIG. 8B), or the like. The side wall 89 of the screw head 88 is preferably angled with respect to the longitudinal axis $L_2$ of the threaded shaft 82 at a fourth angle $\alpha_2$, preferably 45-degrees, such that a line of contact is formed between the screw head 88 and the inside surface 34 of the side members 30. The screw head 88 may be some other suitable shape, however, that has a smooth side wall for allowing sliding of the screw head 88 along the inside surface 34 of the side members 30, or a frustoconical washer or cone 150 (FIG. 5B) may be used with a conventional machine or wood screw 80 of various sizes. Such a washer 150 allows for additional expansion of the frame when the size of the screw head 88 is insufficient, and the washer 150 also allows for a wide variety of screws 80 to be utilized. The screw 80 is preferably made out of a strong and rigid metal or plastic material.

In use, with the spacer 50 fixed between the abutting side members 30 with each end 65 of the first portion 60 contacting the contact surface 48 of each side member 30, and with the screw 80 threaded through the central aperture 70 of the first portion 60 and the side wall 89 of the screw head 88 contacting the inside surface 34 of each side member 30, the threaded shaft 82 of the screw 80 at least partially resting in the groove 40 of each side member 30, rotating the screw 80 to move the screw head 88 closer to the spacer 50 causes the spacer 50 to push the side members 30 mutually away from each other along their respective longitudinal axes $L_1$ to stretch the canvas 20.

Figure 5A:
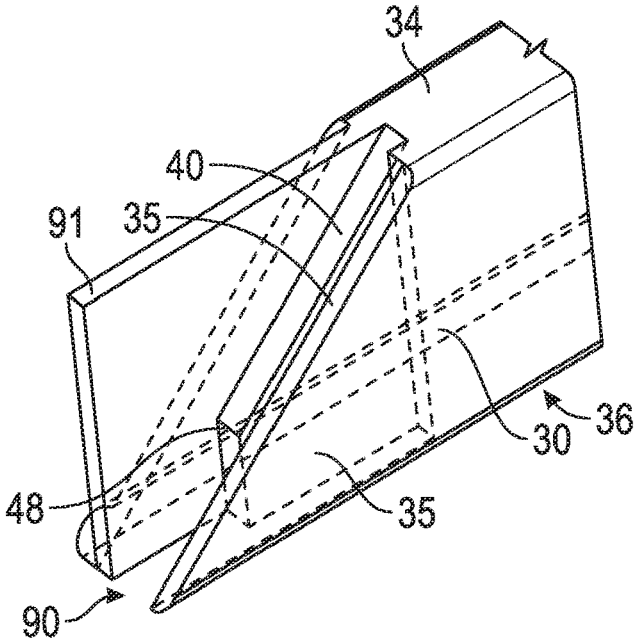
FIG. 5A is a perspective view of an alternate embodiment of a side member having a groove terminating in a contact surface.
Figure 5B:
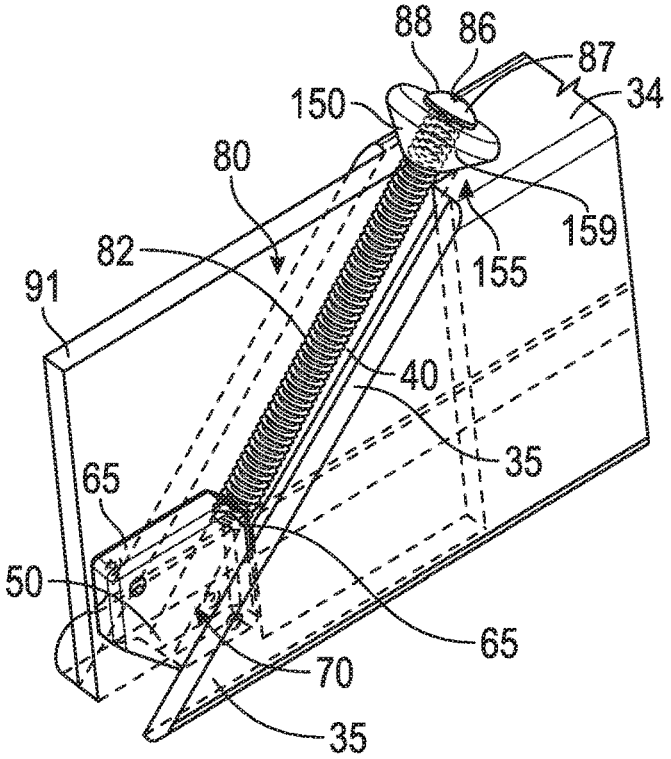
FIG. 5B is a perspective view of the embodiment of FIG. 5A additionally showing a screw and a spacer engaged with the groove of an angled end of the side member.

In a preferred embodiment of the invention, illustrated in FIGS. 5A and 5B, the spacer 50 includes adjacent sides 65 that are sized to engage the contact surface 48 of the side member 30, which is orthogonal to the longitudinal axis $L_1$ of the side member 30. The screw head 88 of the screw 80 in such an embodiment either has its own angled side wall 89 (FIG. 4), or takes the form of a conventional screw 80 having the screw collar 150 (FIG. 5B) having an angled side wall 159 and an axial aperture 155 therethrough to receive the screw 80. Such a screw collar 150 may be formed of, for example, a plastic or metal material, and is preferably separable from the screw 80. As such a wide variety of different screws 80 may be utilized as long as they engage the central aperture 70 of the spacer 80 and the axial aperture 155 of the screw collar 150.

The side members 30 used in the preferred embodiment of the device 10 each include a mortise 90 and a tenon 91 (FIGS. 5A & 5B), with the groove 40 preferably centrally disposed therebetween, such that the side members 30 can be made identical and they will interlock when flipped with respect to each other and brought into abutting contact.

Figure 6A:
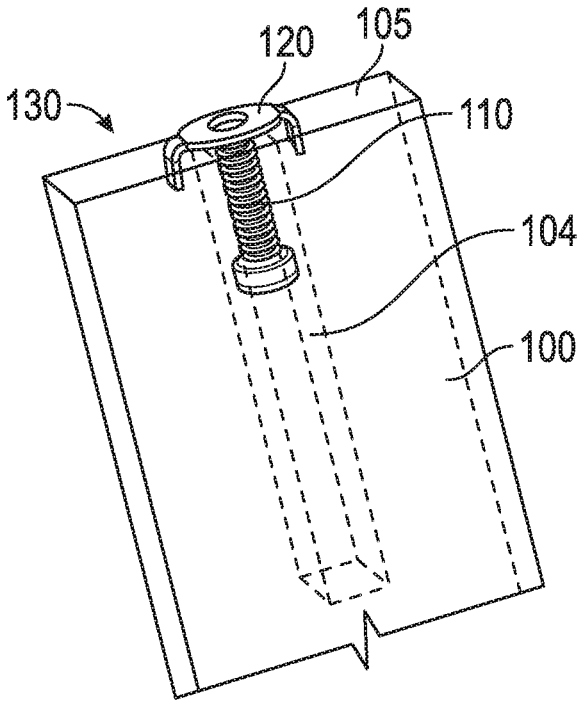
FIG. 6A is a perspective view of an end of a cross bar, showing an expansion screw in a fully retracted position and captured by a threaded spacer.
Figure 6B:
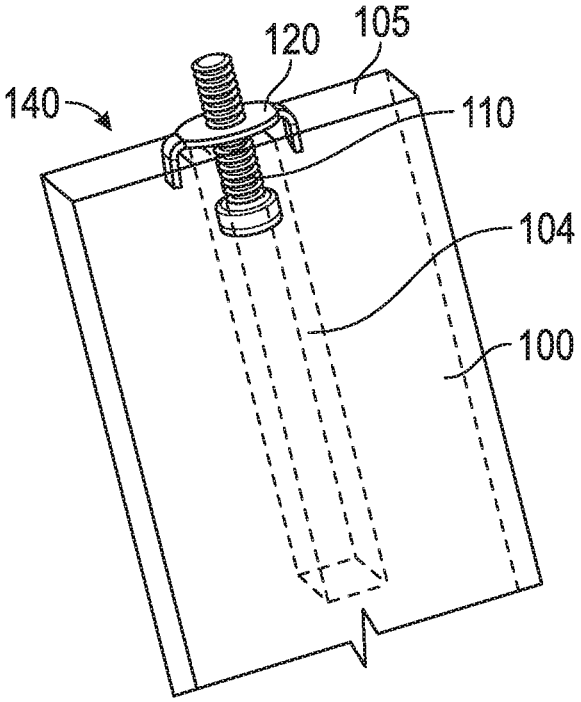
FIG. 6B is a perspective view of the cross bar of FIG. 6A, showing the expansion screw in an extended position.

Further, in some embodiments, at least one elongated cross bar 100 (FIGS. 1, 6A, 6B) is included for applying tension between two opposing side members 30 of a frame 200 comprising four of the side members 30. Each cross bar 100 includes two opposing ends 105, at least one of which has a channel 104 therein for receiving an expansion screw 110 and a threaded spacer 120 that is fixed with the at least one end 105 of the at least one elongated cross bar 100. The threaded spacer 120 includes a central aperture adapted for receiving the expansion screw 100 therethrough. As such, with the cross bar 100 fixed between two opposing side members 30 the at least one expansion screw 110 can be rotated to cause the expansion screws 100 to move from a retracted position 130 to extended positions 140 in order to apply tension between the two opposing side members 30.

Figure 7:
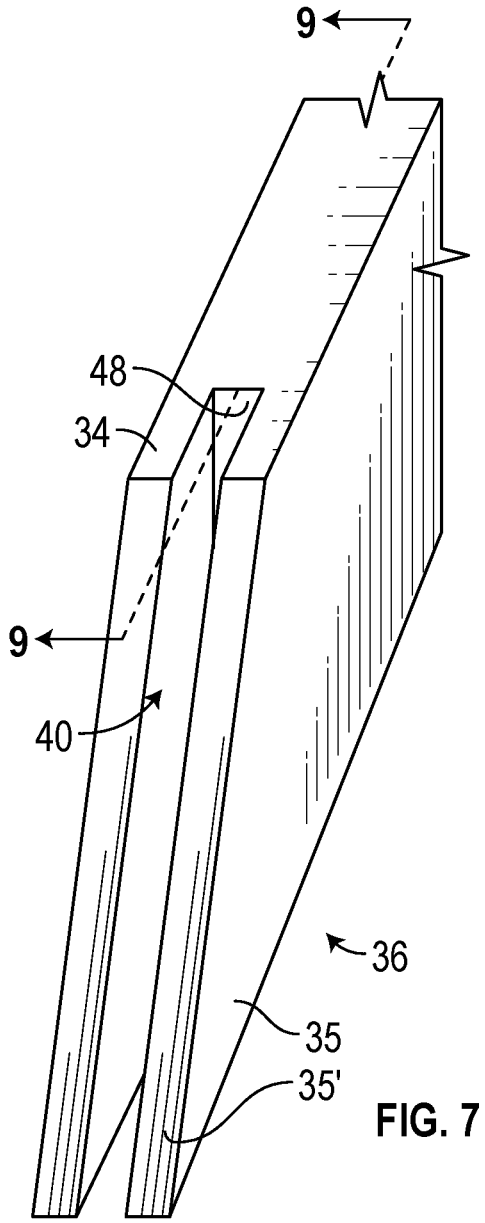
FIG. 7 is a perspective view of an alternate embodiment of the angled end of the side member.
Figure 9A:
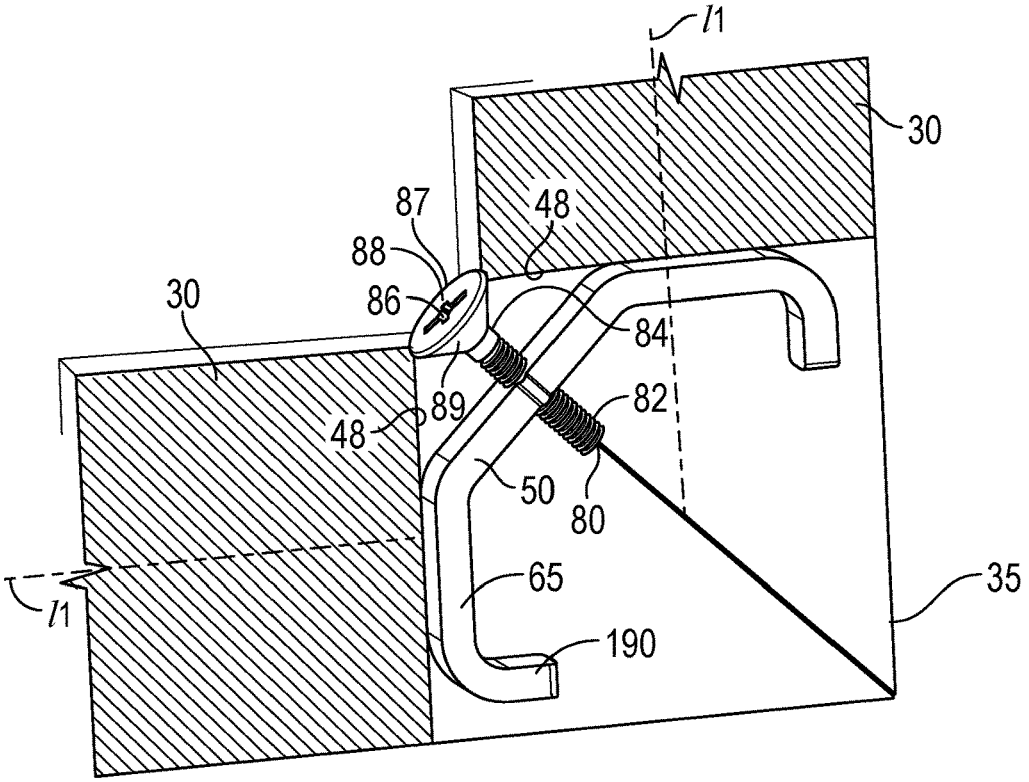
FIG. 9A is a cross-sectional view of the embodiment of FIG. 7, taken generally along line 9-9 of FIG. 7 and showing two of the side members abutting and in mutual contact.
Figure 9B:
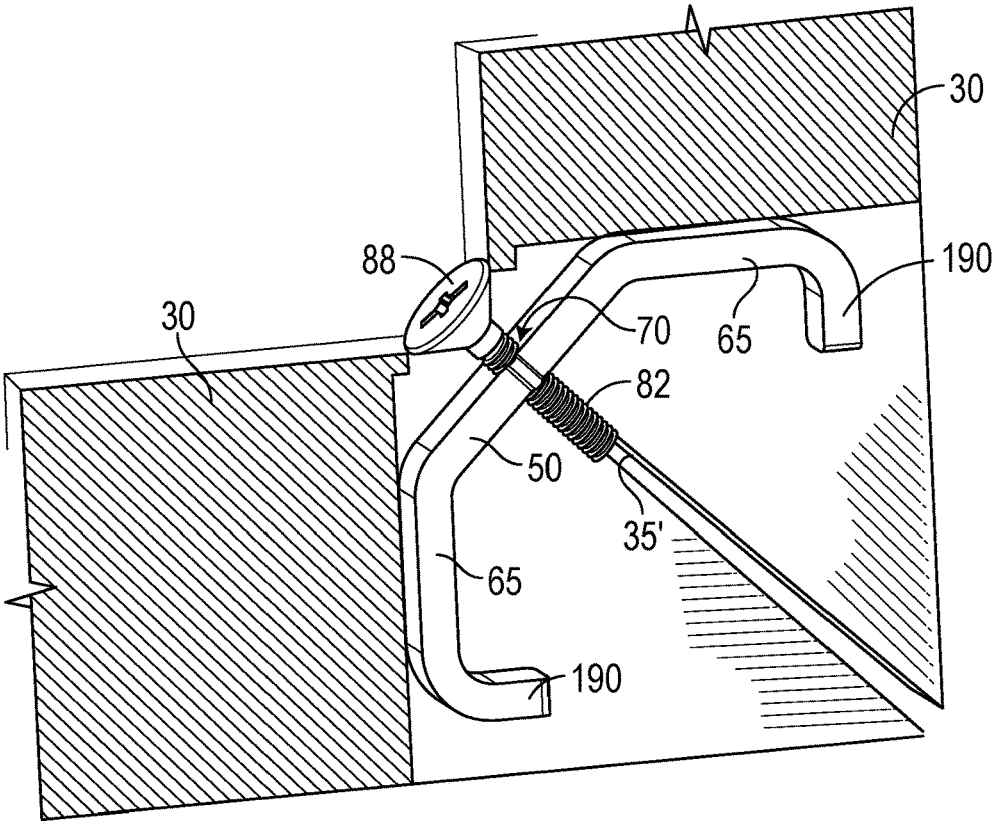
FIG. 9B is a cross-sectional view of the embodiment of FIG. 7, taken generally along line 9-9 of FIG. 7 and showing the two side members spaced apart under a force between the screw head and the spacer.

In some embodiments, the angled ends 35 of the side members 30 do not include the mortise 90 or tenon 91 (FIGS. 7, 9A, and 9B). In some embodiments, the spacer 50 further includes a second portion 190 projecting away from each end 65 (FIGS. 9A, 9B) for stabilization of the spacer 50.

In one method of practicing the invention, at least four of the side members 30 may be assembled into the frame 200 with the spacers 50 fixed between each side member 30. The canvas 20 can then be stretched over each side member 30 and secured thereto, such as with adhesive, staples, sonic welding, or the like. Such an assembly can then be sold to an end user, who acquires the screws 80 separately and, if desiring to further stretch the canvas, threads the screws 80 into the central threaded aperture 70 of the spacers 50 until the frustoconical side walls 89 of each screw 80 contact the inside surfaces 34 of each side member 30 to squeeze each side member 30 apart, further stretching the frame.

Alternately each side member 30, spacer 50, screw 80, cross bar 100, and canvas 20 can be sold in a kit form (not shown), in a pre-assembled form with the screws 80 already threaded through the central threaded apertures 70 of the spacers 50. Alternately, the side members 30, spacers 50, screws 80, cross bars 100, and canvas 20 can be sold separately so that an end user can mix-and-match the parts needed for his desired size and shape of frame 200.

While a particular form of the invention has been illustrated and described, it will be apparent that various modifications can be made without departing from the spirit and scope of the invention. For example, various types of tool-engaging recesses 86,286 not illustrated herein may be utilized. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms.

Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways.

Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A device for stretching a canvas mounted to a pair of side members each mutually abutting at angled ends that each have at least an inside surface, and an angled end surface having a groove open to each angled end surface and a contact surface that is adjacent the angled end surface and that is generally orthogonal to the longitudinal axis of the side member, the device comprising:

a spacer having a central aperture therethrough and two adjacent, opposing sides, each side of the spacer sized to engage the contact surface of one of the side members when the aperture is positioned between two of the abutting side members at the angled end surfaces thereof; and a screw having a threaded shaft adapted for rotational engagement with the central aperture of the spacer, the threaded shaft terminating at a first end thereof with a screw head having an end surface having a tool-engaging recess, the threaded shaft received at least partially within the groove of each side member, the screw head fixed with at least one side wall adapted for contacting the inside surface of each side member, the threaded shaft of the screw engaging solely with the spacer;

whereby with the spacer fixed between the abutting side members with each end of the first portion contacting the contact surfaces of each side member, and with the screw threaded through the central aperture of the spacer and the side wall contacting the inside surface of each side member, rotating the screw to move the screw head closer to the spacer to cause the spacer to push the side members mutually away from each other along their respective longitudinal axes to stretch the canvas.

2. The device of claim 1 wherein the spacer includes a substantially solid block.

3. The device of claim 1 wherein the spacer includes a substantially rigid first portion that includes the central aperture therethrough, the first portion terminating with the opposing sides angled away from the first portion.

4. The device of claim 1 wherein the threaded shaft of the screw terminates at a second end, opposite the first end, with a second head having an end surface with a tool-engaging recess.

5. The device of claim 1 wherein the at least one side wall is a frustoconical side wall of the screw head.

6. The device of claim 1 wherein the at least one side wall is incorporated into a frustoconical washer engaged with the screw.

7. The device of claim 1 wherein the at least one side wall is included with a pressure bracket having a central aperture and two opposing ends, each end of the pressure bracket terminating in one of the at least one side walls and adapted for contacting the inside surface of each side member.

8. A device for stretching a canvas, comprising:

at least four side members each mutually abutting at angled ends that each have at least an inside surface, and an angled end surface having a groove open to each angled end surface and a contact surface that is adjacent the angled end surface and that is generally orthogonal to the longitudinal axis of the side member;

at least four spacers each having a central aperture therethrough and two adjacent, opposing sides, each side of each spacer sized to engage the contact surface of one of the side members when the aperture is positioned between two of the abutting side members at the angled end surfaces thereof; and at least four screws each having a threaded shaft adapted for rotational engagement with the central aperture of one of the spacers, the threaded shaft terminating at a first end thereof with a screw head having an end surface having a tool-engaging recess, the threaded shaft received at least partially within the groove of two abutting side members, the screw head fixed with at least one side wall adapted for contacting the inside surface of each abutting side member, the threaded shaft of the each of the at least four screws engaging solely with respective ones of the at least four spacers;

whereby with the canvas mounted to each side member, each side member abutting two of the other side members, and each spacer fixed between each two abutting side members with each end of the first portion contacting the contact surfaces of each side member, and with the screw threaded through the central aperture of the spacer and the side wall contacting the inside surface of each side member, rotating the screw to move the screw head closer to the spacer causes the spacer to push the side members mutually away from each other along their respective longitudinal axes to stretch the canvas.

9. The device of claim 8 wherein each spacer includes a substantially solid block.

10. The device of claim 8 wherein each spacer includes a substantially rigid first portion that includes the central aperture therethrough, the first portion terminating with the opposing sides angled away from the first portion.

11. The device of claim 8 wherein the threaded shaft of each screw terminates at a second end, opposite the first end, with a second head having an end surface with a tool-engaging recess.

12. The device of claim 8 wherein the at least one side wall of each screw is a frustoconical side wall of the screw head.

13. The device of claim 8 wherein the at least one side wall is incorporated into a frustoconical washer engaged with the screw.

14. The device of claim 8 wherein the at least one side wall of each screw is included with a pressure bracket having a central aperture and two opposing ends, each end of the pressure bracket terminating in one of the at least one side walls and adapted for contacting the inside surface of each side member.

15. The device of claim 8 further including at least one elongated cross bar having two opposing ends, at least one of the ends having a channel therein for receiving an expansion screw and a threaded spacer fixed with the at least one end, the threaded spacer including a central aperture adapted for receiving the expansion screw therethrough, whereby with the cross bar fixed between two opposing side members the at least one expansion screw can be adjusted to apply tension between the two opposing side members.

16. The device of claim 8 wherein the angled ends of each side member include a mortise and a tenon, whereby any two of the side members interlock when one is flipped with respect to the other and brought into abutting contact.

17. The device of claim 16 wherein the groove of each angled end of each side member is disposed between the mortise and tenon of each angled end of each side member.

18. A device for stretching a canvas using at least four screws each having a threaded shaft terminating at a first end thereof with a screw head having a frustoconical side wall and an end surface having a tool-engaging recess, the device comprising:

at least four side members each mutually abutting at angled ends that each have at least an inside surface, and an angled end surface having a groove open to each angled end surface and a contact surface that is adjacent the angled end surface and that is generally orthogonal to the longitudinal axis of the side member;

at least four spacers each having a central aperture therethrough and two adjacent, opposing sides, each side of each spacer sized to engage the contact surface of one of the side members when the aperture is positioned between two of the abutting side members at the angled end surfaces thereof, the threaded shaft of the each of the at least four screws engaging solely with respective ones of the at least four spacers; and a canvas;

whereby with each side member abutting two of the other side members, and each spacer fixed between each two abutting side members with each end of the first portion contacting the contact surfaces of each side member, and with the canvas mounted to each side member, the screws can be threaded through the central aperture of the spacer with the side wall of the screw heads contacting the inside surface of each side member, and each screw can be rotated to move the screw head closer to the spacer to cause the spacer to push the side members mutually away from each other along their respective longitudinal axes to stretch the canvas.

19. A method for stretching a canvas comprising the steps:

a) providing at least four side members each mutually abutting at angled ends that each have at least an inside surface, and an angled end surface having a groove open to each angled end surface and a contact surface that is adjacent the angled end surface and that is generally orthogonal to the longitudinal axis of the side member; at least four spacers each having a central aperture therethrough and two adjacent, opposing sides, each side of each spacer sized to engage the contact surface of one of the side members when the aperture is positioned between two of the abutting side members at the angled end surfaces thereof; and a canvas;

b) fixing each spacer between each two abutting side members with each end of the first portion contacting the contact surfaces of each side member;

c) assembling the side members together to build a frame;

d) stretching the canvas over each side member of the frame and securing the canvas to each side member;

e) providing at least four screws, each screw having a threaded shaft adapted for rotational engagement with the central aperture of the spacer, the threaded shaft terminating at a first end thereof with a screw head having an end surface having a tool-engaging recess; and f) threading the screws through the central aperture of the spacer with the side wall of the screw heads contacting the inside surface of each side member, and rotating the screw to move the screw head closer to the spacer to cause the spacer to push the side members mutually away from each other along their respective longitudinal axes to further stretch the canvas, the threaded shaft of each of the at least four screws engaging solely with respective ones of the at least four spacers.

20. The method of claim 19, further including the step of interlocking the angled ends of each side member, wherein the angled ends of each side member include a mortise and a tenon, whereby any two of the side members interlock when one is flipped with respect to the other and brought into abutting contact.

* * * * *